United States Patent [19]

Gatchel et al.

[11] Patent Number: 4,917,380

[45] Date of Patent: Apr. 17, 1990

[54] TABLE TENNIS BALL SERVING DEVICE

[75] Inventors: Gary Gatchel, Rockford, Ill.; Joseph E. Newgarden, Biscayne Park; Gordon E. Lynn, Carol City, both of Fla.

[73] Assignee: Joseph E. Newgarden, Gallatin, Tenn.

[21] Appl. No.: 143,565

[22] Filed: Jan. 13, 1988

Related U.S. Application Data

[62] Division of Ser. No. 719,872, Apr. 3, 1985.

[51] Int. Cl.[4] ..... A63B 39/00

[52] U.S. Cl. ..... 273/30

[58] Field of Search ..... 273/30, 410, 26 A, 181 F, 273/26 D, 407

[56] References Cited

U.S. PATENT DOCUMENTS 3,911,888 10/1975 Harvath ..... 273/30

4,559,918 12/1985 Ballerin et al. ..... 273/30

*Primary Examiner*—Edward M. Coven

*Assistant Examiner*—Dean Small

*Attorney, Agent, or Firm*—Polster, Polster and Lucchesi

[57] ABSTRACT

A portable, automatic serving device for table tennis is provided which includes a robot server and ball capture net. The robot includes a serving head which is mounted for rotation with respect to the body along a plurality of axes. The head is provided with balls from a passageway in the robot operatively connected between the head and the base of the robot. A collapsible net is provided for capturing balls returned by a player. The robot is positioned within and cooperates with the net so that return balls are fed automatically to the head. The robot is operated by three motors, which may be controlled individually to serve sequentially a plurality of balls to a player for practice or for sport. The robot construction provides for a variety of ball delivery techniques, all of which are controlled simply during operation.

6 Claims, 7 Drawing Sheets

TABLE TENNIS BALL SERVING DEVICE

BACKGROUND OF THE INVENTION

This invention relates to ball throwing devices, and in particular, to a portable net and robot for recycling and sequentially serving a plurality of table tennis balls to a player at adjustable rates and trajectories. While the invention is described with particular emphasis on the application to table tennis robots, those skilled in the art will recognize the wider applicability of the inventive principles disclosed hereinafter.

Various devices for serving balls to players, for practice or for sport, in games such as table tennis, tennis, and baseball are well known in the prior art. For example, the U.S. Patent to Littell et al, No. 2,087,575, issued July 20, 1937, describes devices that can be employed in table tennis, for example, for ejecting lightweight balls. The device disclosed in Littell includes an overhead supply means, typically in the form of an overhead hopper. The overhead hopper is fed by a conveyor system having a series of ball carrying members mechanically mounted for movement in a continuous loop.

U.S. Patent to Lemon, No. 2,508,461, issued May 23, 1950, describes an apparatus for ejecting table tennis balls employing pressurized air, as from a home vacuum cleaner, to propel and eject the balls from a conduit. A gravity fed collector box is provided for introducing a ball into a lower portion of the conduit. The Lemon device provides no control on the entrance of the balls, and failure of the balls to feed properly can result in a loss of air pressure particularly as a plurality of balls are introduced into the system.

U.S. Patent to Schrier et al, No. 3,917,265, issued Nov. 4, 1975, is another pneumatic ball ejecting machine including pneumatic means for transporting the balls from a collection source, for loading the balls to an ejection means and for ejecting the balls. Again, maintenance of air pressure in the device is critical. The ejection means includes a plurality of barrels mounted at fixed angles with respect to each other so as to provide a predetermined number of variations in the trajectories of the ejected balls. The spin on an ejected ball is imparted through random contact between the ball and the wall of a particular barrel as the ball is propelled through that barrel. This results in a uncontrollable assortment of spins.

The U.S. Patent to Berliner, No. 4,116,438, issued Sept. 26, 1978, describes a device for throwing table tennis balls, having a mechanical throwing means including two flexible, thin throwing discs extending generally parallel with respect to each other, for grasping a table tennis ball between them and ejecting it along a guide. The material properties of the discs thus are important considerations, due to the repeated flexure of the discs. Balls also are returned to the serving discs by a pneumatic means. The U.S. Patent to Cook, No. 2,793,636, issued May 28, 1957, describes a fan operated device, as does the U.S. Patent to Horvath, No. 3,911,888, and the U.S. Patent to Augustine, No. 3,989,245.

The U.S. Patent to Newgarden, No. 3,794,011, issued Feb. 26, 1974, describes a relatively simple device for imparting variations in the amount of spin applied to a ball being served by a server. The disclosure of the Newgarden patent is intended to be incorporated herein by reference.

While all of these prior art devices, and others in the art, work for their intended purposes, it is evident from the large number of these devices, that no one device has solved the problems of providing a low cost, reliable, and relatively uncomplicated automatic serving device for table tennis. Pneumatic devices are inherently unreliable. Mechanically operated devices have been relatively complex if full functions were to be provided. Even when mechanical devices were simplified, they lacked the ability to provide a full range of shots for practice or sport.

The invention disclosed hereinafter overcomes these prior art deficiencies by providing a relatively low cost, simple to construct robot that provides a full range of play both for practice and for sport. The robot, in combination with a return net, provides for automatic replay of balls returned by player. The device construction provides mechanical simplicity, low cost, and a wide range of shot capabilities.

One of the objects of this invention is to provide a portable table tennis ball serving device which closely emulates the variety of serves expected from a human competitor.

Another object of this invention is to provide an elevated serving device which is automatically supplied with balls from the level of a playing surface, without the need of overhead hoppers.

Another object of this invention is to provide a table tennis ball serving device which will not cause excessive wear or deformation of the balls during the course of operation of the device.

Another object of this invention is to provide a ball serving device which can be regulated remotely from the ball serving device;

Yet another object of this invention is to provide a ball serving device which is relatively easy to set-up and remove from a set-up condition.

Another object of this invention is to provide a table tennis ball serving device which will precisely duplicate various combinations of ball velocity, spin and trajectory, as well as adjustable rates of serve, in order to permit repeated practice of a particular shot or return.

Another object of this invention is to provide a ball throwing device of flexible operation and performance, but of relatively simple and inexpensive construction.

Another object of this invention is to provide a ball throwing device having component parts which are not subject to excessive wear during extended use.

Another object of this invention is to provide a ball serving device which will recycle returned balls to permit continuous practice or play with a minimum number of balls.

Another object of this invention is to provide a ball serving device which will automatically vary the trajectory of a served ball through a predictable pattern.

Another object of this invention is to provide a robot serving device which has a controllable panning pattern for the serving head.

Other objects of this invention will be apparent to those skilled in the art in light of the following description and accompanying drawings.

SUMMARY OF THE INVENTION

In accordance with this invention, generally stated, a robot ball serving device is provided particularly adapted for use in the game of table tennis. The robot has a serving head adjustable about three axes of a conventional cartesian coordinate system, one of which is oriented generally vertically. A simplified panning system operates in conjunction with the serving head to vary the position of delivery of balls expelled from the serving head. Rotation of the head varies the spin imparted to the ball. Preferably, a net is provided to capture balls returned by a player. Simplified structure is used to feed returned balls back to the head.

DESCRIPTION OF THE PREFERRED EMBODIMENT

Figure 1:
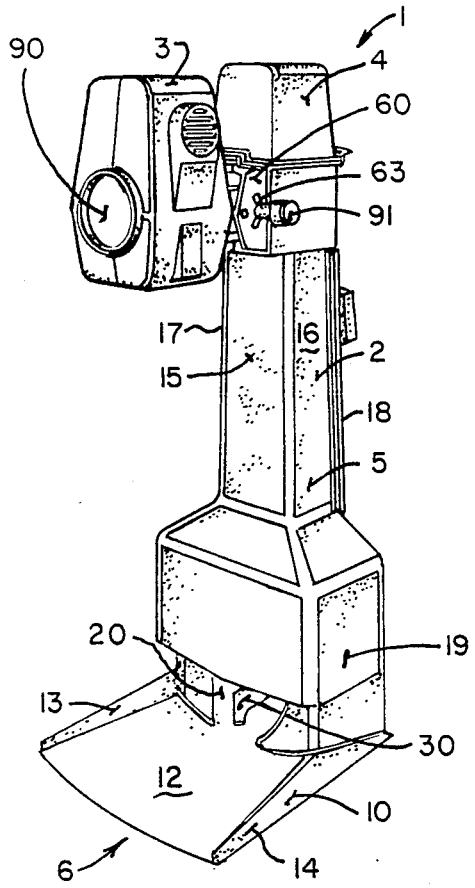
FIG. 1 is a view in perspective of one illustrative embodiment of ball serving device of this invention.
Figure 11:
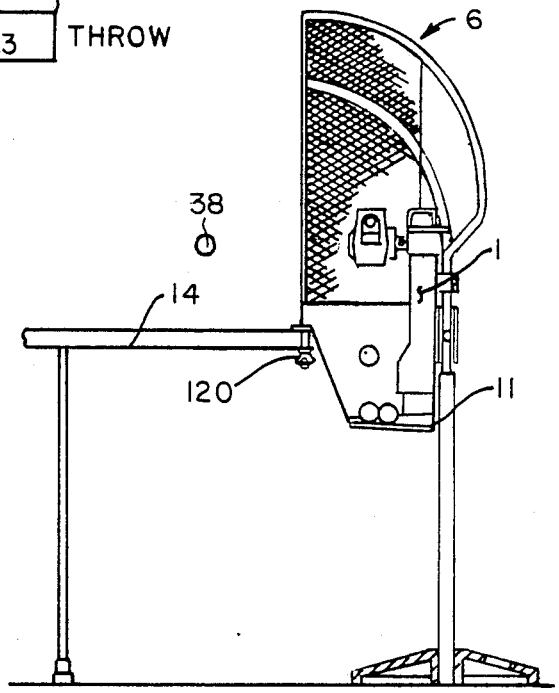
FIG. 11 is a view in side elevation of the net and robot as shown in FIG. 10.

Referring now to the FIG. 1 reference numeral 1 indicates one illustrative embodiment of robot ball serving device of this invention. The robot 1 includes an enclosure 2 generally delimiting a serving head 3, a panning system 4 and a body 5, the robot 1 being utilized in conjunction with a net assembly 6, best seen in FIGS. 10 and 11, and later described in greater detail.

The body 5 includes a base 10 having a entrance 11 defined by a bottom 12 and sides 13 and 14 respectively.

An upper portion of the body 5 is generally rectangular in plan, having a front 15, sides 16 and 17 and a back 18. A lower portion of the body 5 is enlarged along a part 19. The part 19 is designed to mate with the base 10 by any convenient method. The front 15 of the body 5 has a mouth 20 formed in it along the junction of the bottom 12 of the entrance 11 and the enlarged part 19 of the body 5. As thus described, the entrance 11 is designed to feed table tennis balls, for example, rearwardly toward the mouth 20.

Figure 3:
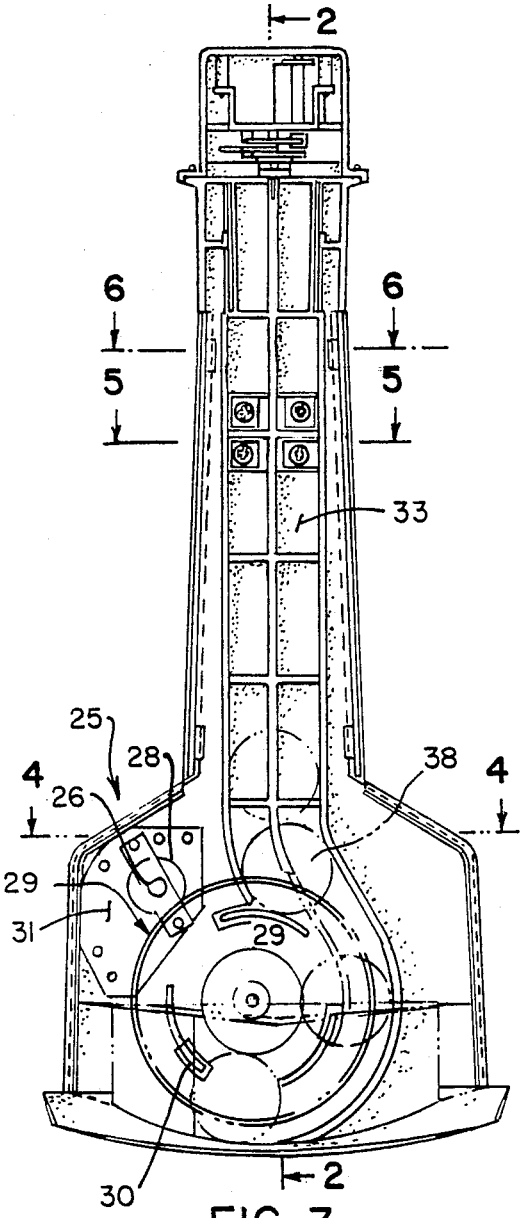
FIG. 3 is a sectional view, taken along the line 3—3 of FIG. 2.

As is best seen in FIGS. 1 and 3, the enlarged part 19 is arranged to house a feed mechanism 25. The feed mechanism 25 functions to engage balls, for example, as they arrive at the entrance 11 and mouth 20 and bring them inwardly of the body 5 of the robot 1. The mechanism 25 includes a feed motor 26 Which drives a gear train 27. The gear train 27 includes a first relatively smaller gear 28 driven by the motor 26 and a enlarged gear 29. The gear 29 has a plurality of fingers 30 mounted to it. The fingers 30 rotate with the gear 29 and are adapted to engage balls of the table tennis variety, for example, and force them inwardly of the body 5 of the enclosure of the robot 1. As will be appreciated, the fingers 30 can assume a variety of design shapes, and the number of fingers 30 may vary in other embodiments of this invention.

The feed motor 26 and the gear train 27 are mounted within the body 5 in any convenient way. In the embodiment illustrated, the motor 26 is attached to a bracket 31 which in turn is attached to a wall of the body 5. Threaded fasteners work well as the attachment means. The motor 26 is a conventional alternating current drive motor which has an output shaft mounted to the gear 28 of the gear train 27. The gear 28 in turn intermeshes with the gear 29 to drive that gear and rotate the fingers 30.

Figure 6:
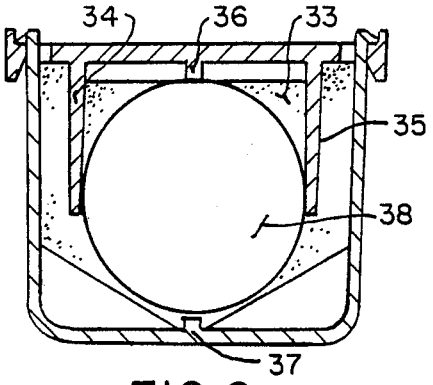
FIG. 6 is a sectional view, taken along the line 6—6 of FIG. 3.
Figure 5:
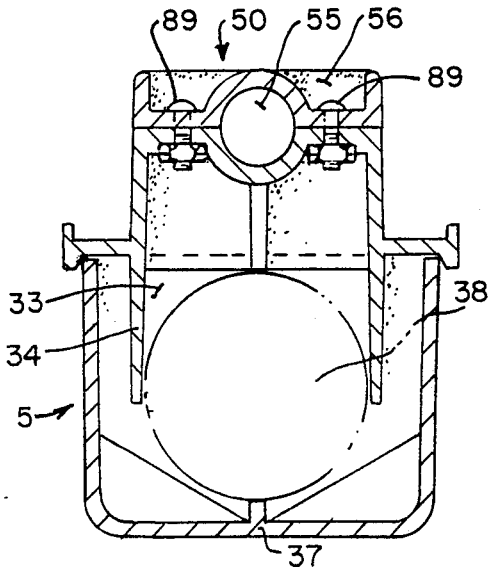
FIG. 5 is a sectional view, taken along the line 5—5 of FIG. 3.

The body 5 of the enclosure 2 delimits an internal feed passage 33, which is best observed in FIGS. 3, 5 and 6. The feed passage 33, in the embodiment illustrated, is defined by a plurality of internally formed walls 34, 35, 36, and 37. The walls 34–37 extend vertically downwardly along the passage 33, and provide point contact for a plurality of balls 38 as they are fed upwardly in the passage 33 by the feed mechanism 25. Also mounted to the body 5 is an attachment device 50, which is shown in FIG. 5, and later described in greater detail. It is here noted that the attachment device 50 is utilized to mount the robot 1 of this invention to the net assembly 6.

Figure 2:
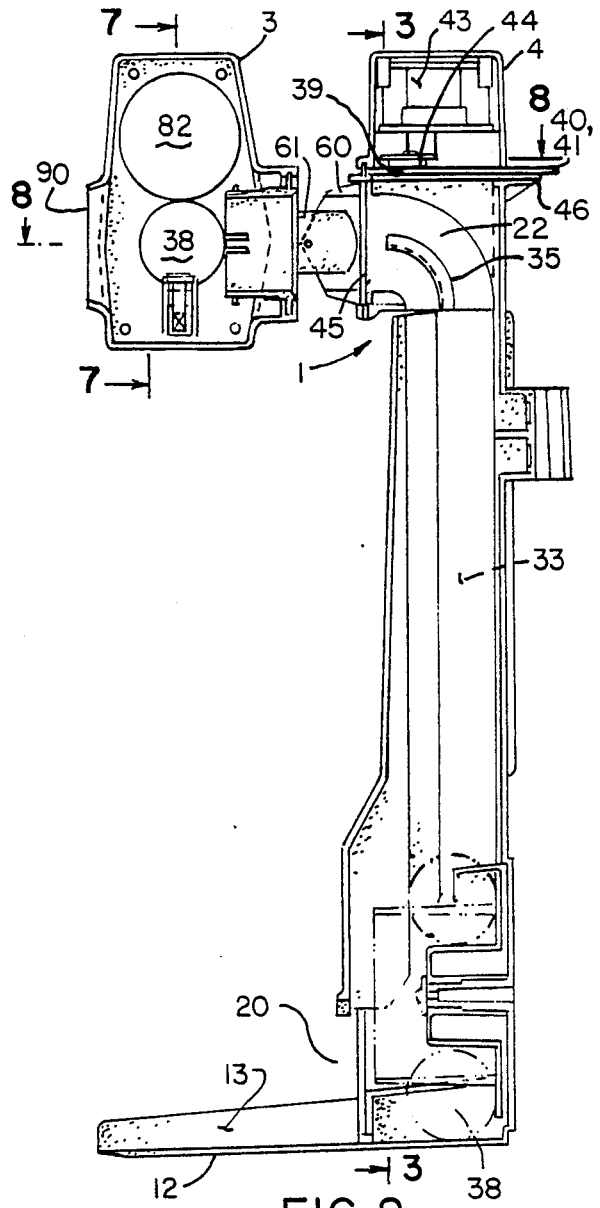
FIG. 2 is a side sectional view thereof.
Figure 4:
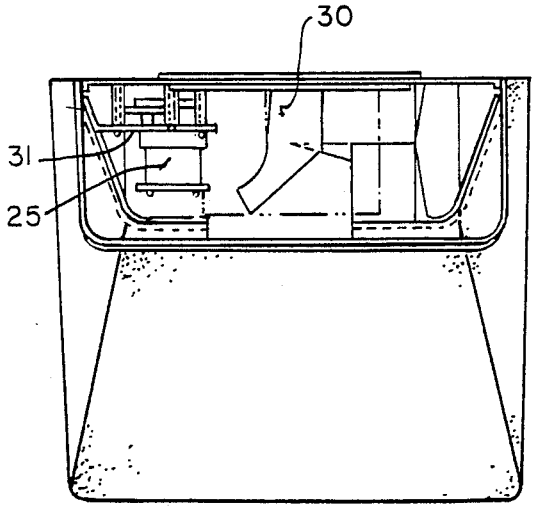
FIG. 4 is a sectional view, taken along the line 4—4 of FIG. 3.

As is observable in FIG. 2, the feed passage 33 extends from the mouth 20 to the serving head 3. The feed passage is generally vertical, except along the panning section 4 of the robot 1. At that point, it defines an elbow 22 so as to interconnect the body 5 with the serving head 3.

As thus described, the feed mechanism for the robot 1 is substantially simpler than those known in the prior art in that the robot 1 is designed to return balls along entrance 11 and to feed the balls from the mouth 20 to the head 3. The feed passage is sized so that the balls 38 are relatively close fitting with the passage 33 upon their insertion into the passage 33. That is to say, the balls are free to move in the passage 33 without undue friction, but the passage 33 is sized so that jamming is nonexistent. In addition, the balls are fed magazine style to the serving head 3 in that the ball approaches the serving head from the feed passage 30 only upon the entrance of a new ball under the influence of the fingers 30 into the feed passage 33. Consequently, a player needs only one ball in addition to those aligned in the passage 33 to provide continuous operation of the robot 1. The speed with which balls 38 are engaged by the fingers 30 for insertion within the passage 33 is controlled by the feed motor 26, that speed being variable by the operator of the robot 1.

Figure 8:
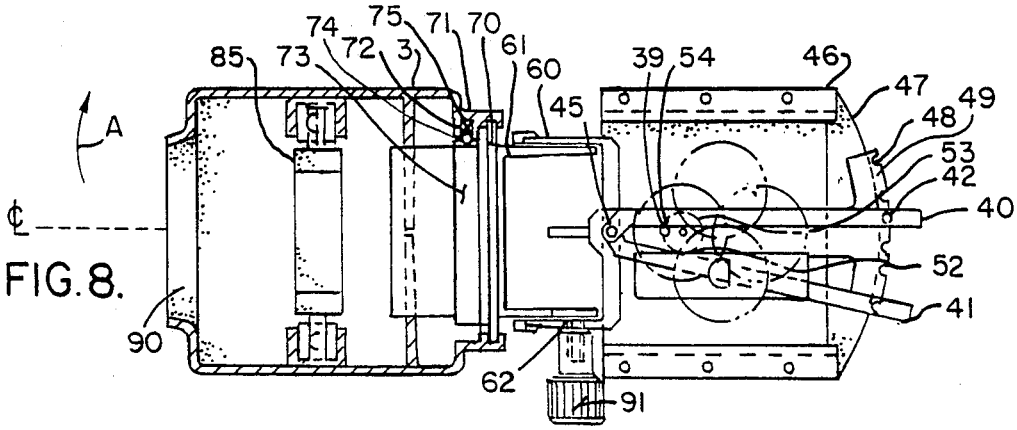
FIG. 8 is a sectional view, taken along the line 8—8 of FIG. 2.
Figure 9:
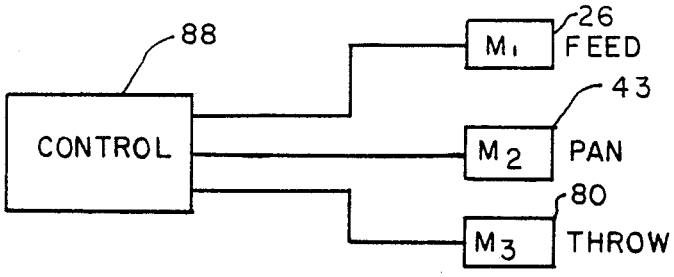
FIG. 9 is a diagrammatic view of the operational control system for the device of FIG. 1.

The panning system 4 and the serving head 3 operate in conjunction with one another to permit variation in the placement of a ball expelled from the serving head 3. As is best seen in FIG. 8, the serving head 3 is mounted to the panning system 4 at a pivot axis 45. The pivot axis 45 is perpendicular to and extends outwardly from and into the plane of the drawing in FIG. 8. Also mounted about the pivot 45 is a flange 46 having a rear edge 47. The edge 47 has a plurality of notches formed in it, for purposes later described. Also attached to the pivot axis 45 are a pair of cam arms 40 and 41 respectively. The cam arms include a stop 42 which is selectively engageable in the notches 48 to position and hold the respective cam arms 41 and 40 in preselected positions. As shown in FIG. 8, the head 3 and the flange 46 are connected to one another by any convenient method, and both may be rotatably driven about the pivot axis 45. The arms 40, 41 and flange 46 are supported on the body 5 in a conventional manner.

Mounted above the cam arms 41 and 42 is a panning motor 43, best seen in FIG. 2. The panning motor 43 is operatively connected to a cam follower driver 44 which has a cam follower 39 mounted to it. The cam follower 39 is adapted to engage the cam arms 40 and 41 and to track along an edge of the arms, during rotation of the cam driver 44.

The simplified structure for providing panning of the serving head 3 is an important feature of our invention. The panning operation is best explained with respect to FIG. 8. As the shaft of the panning motor 43 rotates, it rotates the cam driver 44 in clockwise direction which in turn causes the cam follower 39 engagement with an edge 54 of the cam arm 40. In the position shown in FIG. 8, follower 39/arm 40 engagement causes the follower 39 to impart a force on the arm 40, that force being transmitted through the arm 40/flange 46 engagement with the head 3, in turn causing the head 3 to be rotated counter-clockwise with respect to the centerline axis shown in FIG. 8. As the motor 43 continues to rotate clockwise, however, the cam follower 39 disengages the arm 40 and engages an edge of the arm 41. Initial engagement of the follower 39 with the arm 41 imparts a force which will tend to rotate the head 3 toward the right in the direction of the arrow A shown in FIG. 8. This rotation toward the right continues until the follower 39 disengages the cam arm 41 at a point 52, also shown in FIG. 8. This motion will bring the head rightwardly back toward the centerline axis. As the cam follower 39 re-engages the arm 40 at a point 53, it will exert a force on the arm 40/flange 46 and consequently the head 3 to drive the head 3 again oppositely to the arrow A shown in FIG. 8, so that the head would move in a counter-clockwise direction. As will be appreciated, movement of the cam arm 41 to a position parallel with the cam arm 40 means that the head 3 will attain maximum rotation from the centerline axis shown in FIG. 8. That is to say, when the cam arms 40 and 41 are parallel to one another, maximum force is exerted by the follower 39, causing full panning of the head 3 between full left and full right positions. Movement of the cam arms 40 and 41 to their maximum open position, i.e., their maximum angular relationship, means that the head 3 has minimum motion, if any motion is imparted as all, about the centerline axis.

Also attached to the flange 46 is a C-shaped bracket 60. The bracket 60 is sized to receive a complimentarily C-shaped flange 61. The flange 61 in turn is attached to an enclosure for the head 3. Each of the brackets 60 and 61 preferably have at least one opening formed in them, which is sized to receive a threaded fastener 62. In addition, the bracket 60, as may best be observed in FIG. 1, has a slot 63 formed in it, which receives the threaded fastener 62 and permits rotation of the head 3 about an arc defined by the arc of the slot 63. The head 3 thus may have its "pitch" changed merely by untightening a nut 91 mounted to the fastener 62, adjusting the head 3 to a desired pitch position, and re-tightening the nut 91.

The bracket 61, in the embodiment illustrated, is mounted to a collar 70. The collar 70 receives a flange 71 of the head assembly 3 in a slip friction fit, which permits rotation of the head about the collar 70. Preferably, a detent structure 72, which comprises an bearing race 73, a ball stop 74, and a biasing means 75 is mounted within the collar 70 to permit selective positioning of the serving head 3 with respect to the rotational position of the head.

Figure 7:
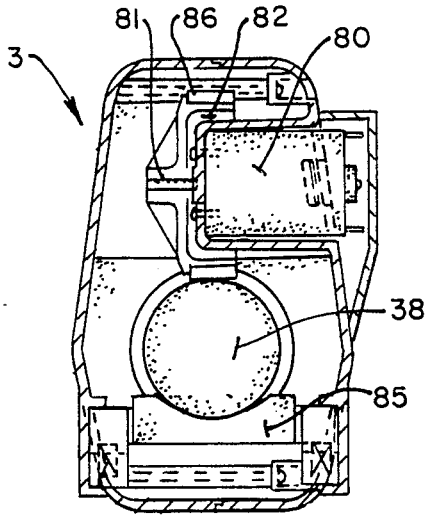
FIG. 7 is a sectional view, partly broken away, taken along the line 7—7 of FIG. 2.

Mounted within the head 3 is a serving wheel drive motor 80, having a shaft 81 operatively connected to a serving wheel 82. A stationary block 85 is mounted along a lower portion of the head 3. As may be seen in FIG. 7, as a table tennis ball 38 approaches the head 3, the ball is engaged by the stationary block 85 and the serving wheel 82. The wheel 82 has an outer surface 86 which preferably is of some form of relatively frictional material for engaging the ball and expelling it from an exit port 90 in the head 3. In the alternative, a dual wheel arrangement can be employed as disclosed in the above-referenced Newgarden Patent No. 3,794,011. We find the use of a stationary block and single wheel, however, an improvement over the Newgarden device in that only one drive wheel is required for device operation. The single wheel eliminates problems with synchronization of the wheels or the motor or motors driving them. Spin or english is imparted to the balls 38 entering the head 3 by rotation of the head 3 about the collar 70. Since the feed passage 33 is stationary, while the head 3 may be rotated with respect to it, balls entering the head 3 may be expelled from the exit port 90 with spin imparted to them, depending upon which way the head 3 is rotated. As indicated above, loft or ball trajectory can be changed by movement of the head 3 along the slot 63 by adjustment of the tightening nut 91. As also previously discussed, the panning motion of the head can be controlled by movement of the cam arms 40 and 41.

Control of the feed, pan and throw motors 26, 43 and 80, respectively, is accomplished through the use of a control means 88. Each of the motors 26, 43 and 80 are intended to be conventional alternating current motors, which may have their speeds controlled by the control means 88. Preferably, individual controls for each of the motors are provided, so that the rate of feed for the feed motor 26, the speed of panning and the rate of expulsion of balls from the exit port 90 may be controlled individually. Because of the novel feed system employed with this invention, however, the feed motor 26 necessarily must operate at approximately the same speed as the wheel drive or throw motor 80 so that balls continually are fed through the feed passage 33. It will be appreciated that the control means 88 may be located remotely from the robot 1 so that a player may vary robot 1 operation as the player practices or plays.

Figure 10:
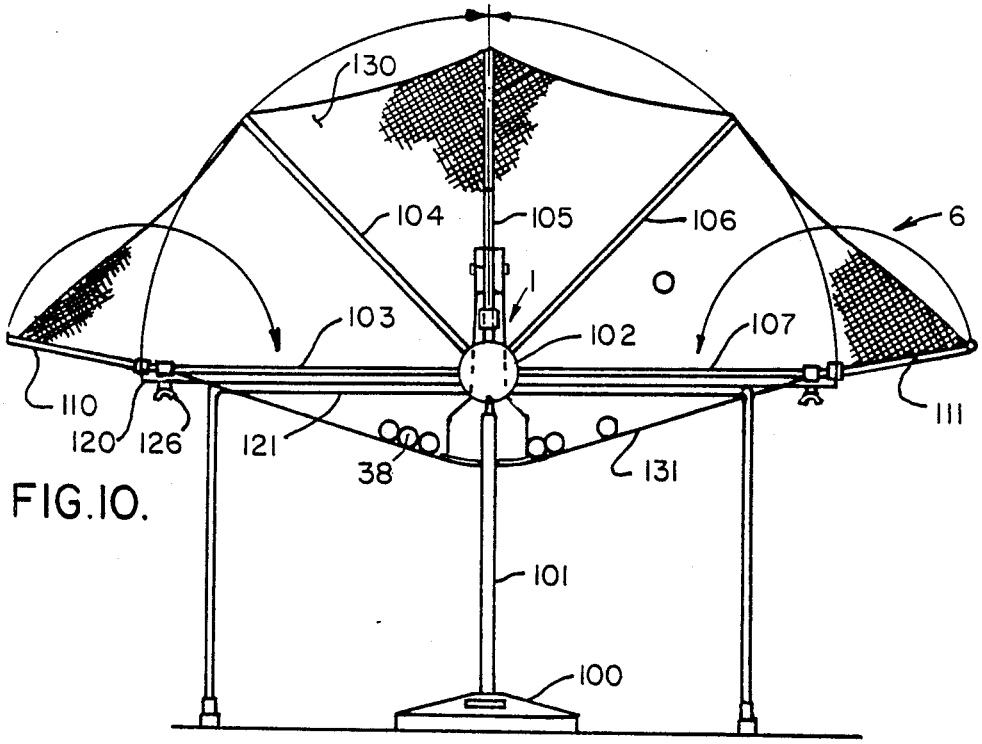
FIG. 10 is a view in front elevation illustrating the net and robot 1 operation of this invention.

Referring now to FIG. 10, the net assembly 6 includes a base 100 having a central pole 101 extending upwardly from it. The pole 101 is attached to a spider 102 having a plurality of arms 103, 104, 105, 106, and 107 extending outwardly from it. The number of arms and their angular position with respect to the spider 102 may vary in embodiments of this invention. The arms 103–107 are intended to be foldable upon one another into an upright position, as indicated by directional arrows in FIG. 10. An extension of the arms 103 and 104, indicated by the numerals 110 and 111, respectively, also may be provided, if desired, so that the net assembly extends substantially beyond an end position 120 of a table tennis table 121. The table tennis table 121 is conventional, and it is not described in detail. It is here sufficient to note that the net assembly is intended to extend about the end 20 of the table 121 so that balls returned in response to the robot 1 operation are caught by the net and returned to the robot. The arms 103 and 107 have a plurality of attachment devices 126 associated with them, which permit the arms and net assembly to be attached to the table 121. We find that conventional wing nuts and threaded fasteners work well for the attachment method, for example.

As indicated above, the robot 1 has an attachment means 50 associated with it. In the embodiment illustrated in FIG. 5, the attachment means 50 includes a flange 56 which defines a central opening 55 sized to receive the arm 105. The robot 1 and the arm 105 are attached to one another by conventional methods. Again, threaded fasteners 89 work well. The robot 1 is slidable on the arm 101 for purposes later described merely by adjusting the fastener 89.

A conventional net 130 is stretched over the arm of the net assembly 6. The lower portion of the net assembly 6 has a bottom 131 which is attached to the arms 103 and 104 and to the remaining net portions. In the operation of this invention, the robot 1 is positioned so that the entrance 11 of the robot I is positioned below the height of the table 121. This is accomplished by attaching the robot 1 to the arm 105 and sliding the robot downwardly until the bottom 131 of the net assembly is drawn tautly downwardly. As shown in FIG. 1!, this has the effect of forming sloping sides and a sloping front for the bottom 131, so that balls returned to the net assembly 6 are fed directly toward the entrance 11 of the robot.

The particular embodiment shown is well adapted for convertible use. That is to say, once the robot 1 is attached to the net assembly 6, and set up for practice, it may be removed merely by removing the attachment means 126 between the arms 103 and 107 and the table 121. The arms in turn may be folded upwardly, and the device removed from the table 121 in a relatively compact, stored position. Replacement is quickly accomplished in a reverse order in that unfolding of the arms 103–107 and reconnecting the attachment means 126 to the table 121 re-positions the robot 1 for operation.

Operation of the robot 1 of this invention is relatively simple. Once a sufficient number of balls are inserted or fed to the robot 1 so that the feed passage 33 is full, the robot will automatically expel a ball from the exit port 90. As described above, the method of expelling a ball from the exit port 90 will vary depending upon the speed of the feed, pan and throw motors, the location of the panning arms 40 and 41, the rotational position of the head 3 on the collar 70, and the position of the head with respect to the slot 63. All of these may be varied individually or in combination to give a much higher degree of playability and variation to the robot performance than have been available with prior art devices. The simplicity and high performance characteristics of this invention make it unusual from the standpoint of the robot 1's ability to provide that variation at a relatively low cost.

Figure 12:
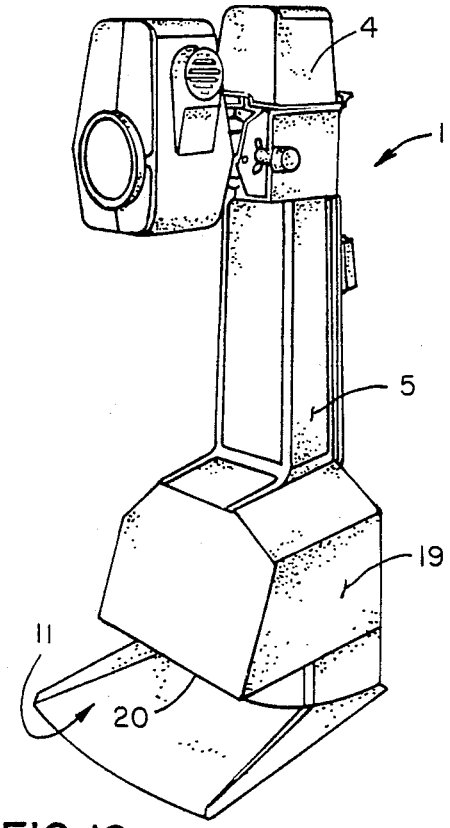
FIG. 12 is a view in perspective of a second illustrative embodiment of the ball serving device of this invention.
Figure 13:
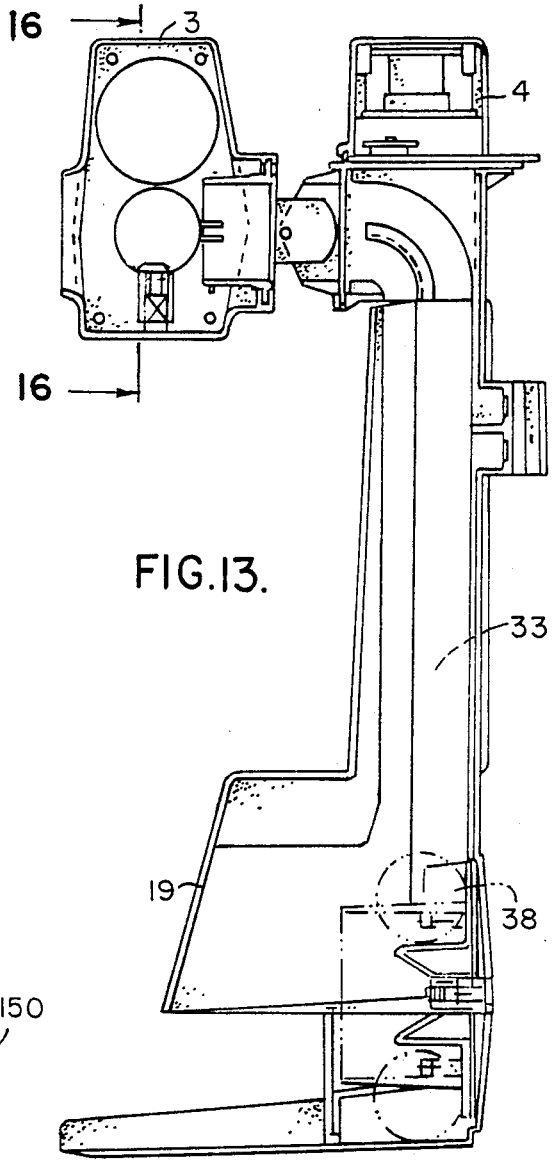
FIG. 13 is a side sectional view thereof.
Figure 14:
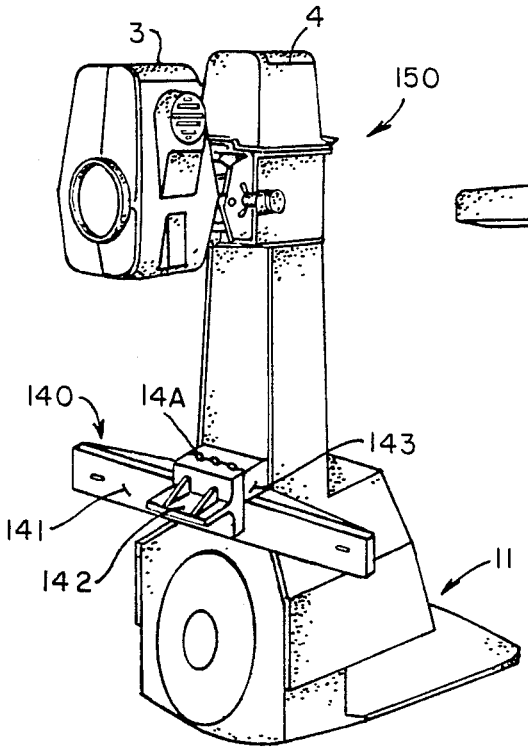
FIG. 14 is a view in perspective of a third illustrative embodiment of ball serving device of this invention.

We envision that the robot 1 of our invention may take a variety of forms. For example, in FIG. 12, the body 5 has an enlarged lower part 19, to provide an enlarged mouth 20 which may aid in feeding the balls to the robot 1.

Figure 22:
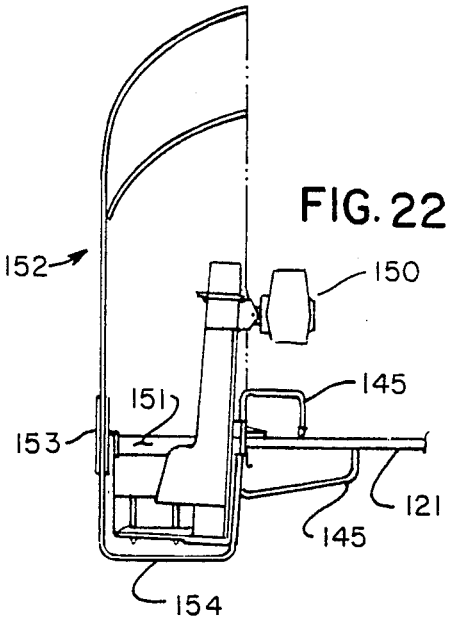
FIG. 22 is a sectional view, partly broken away, taken along the line 22—22 of FIG. 20.
Figure 20:
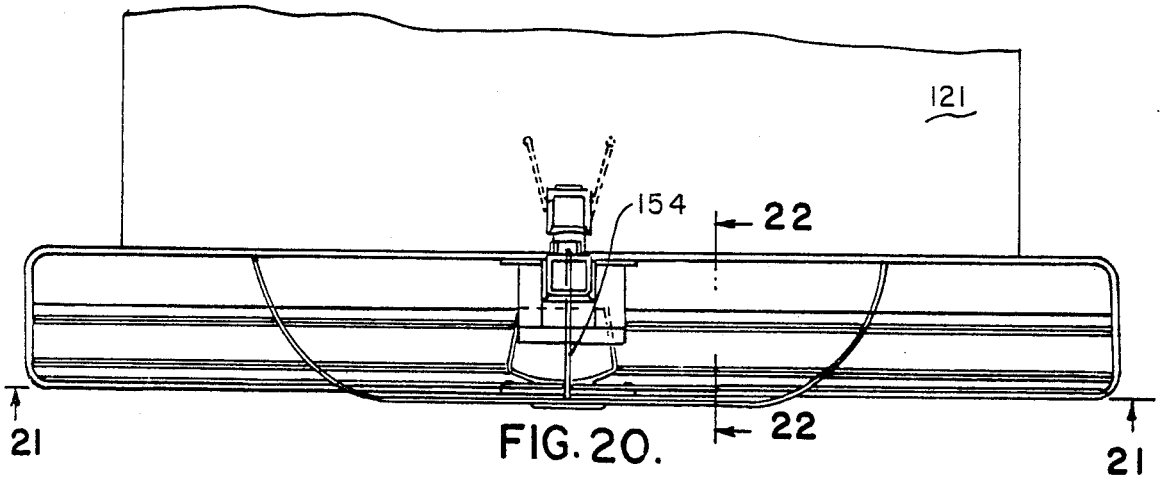
FIG. 20 is a top plan view of a robot and net combination employing the robot of FIG. 12.
Figure 21:
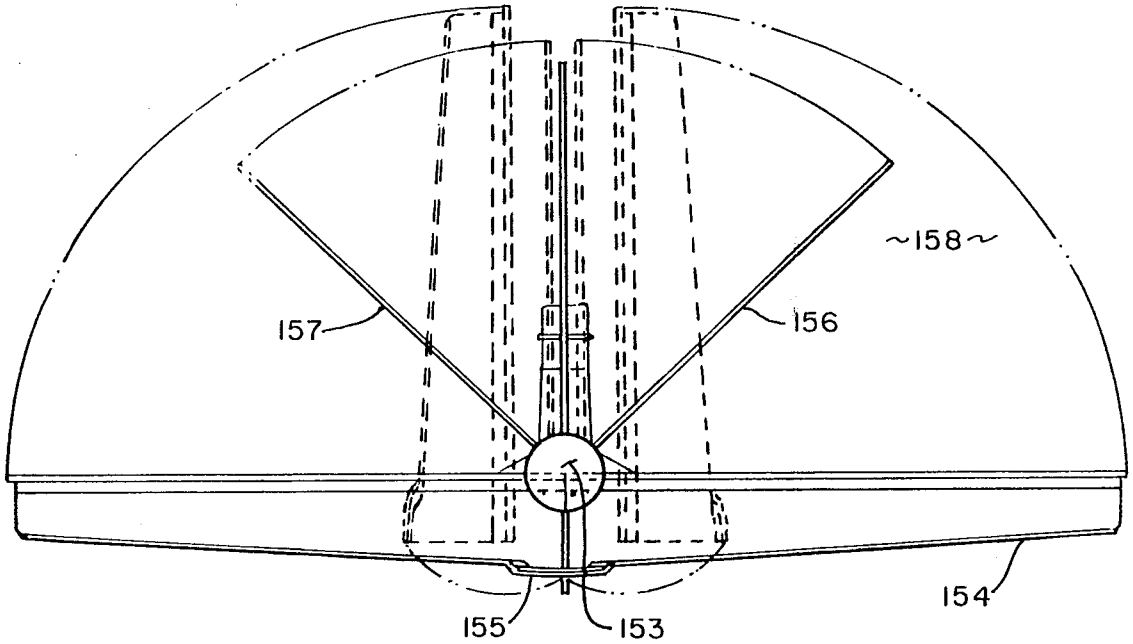
FIG. 21 is taken along the line 21—21 of FIG. 20 illustrating the folded position of the net.

In addition, the entrance 11 of the robot 1 may be rotated 180° so that the robot may be mounted directly to the table 121. Such an embodiment is shown in FIGS. 14 through 21. In general, the robot shown in FIG. 14, and denominated herein as robot 150 is shown as similar to the robot 1 except as described hereinafter. Like numerals are employed for like parts where appropriate. The primary change of the robot 150, as indicated above is the rotation of the mouth 11 for the robot to be rotated 180 with respect to the head 3. A support 140 includes a side edge 141 which is intended to abut an end of the table 121, and a top edge support edge 142, which abuts the top surface of the table 121. The support 141 also includes a block 143 having a plurality of mounting openings 144 formed in it. The openings 144 are intended to receive a plurality of support members 145, best seen in FIG. 22. The supports 145 may be three in number, one shorter supporting arm to engage an upper surface of the table 121, and two smaller supporting arms to engage an underside of the table 121, as best seen in FIG. 22. Other arrangements may be utilized, if desired.

Figure 16:
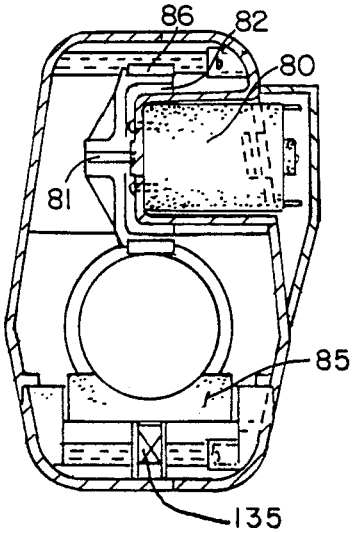
FIG. 16 is a sectional view, partly broken away, taken along the line 16—16 of FIG. 13.
Figure 15:
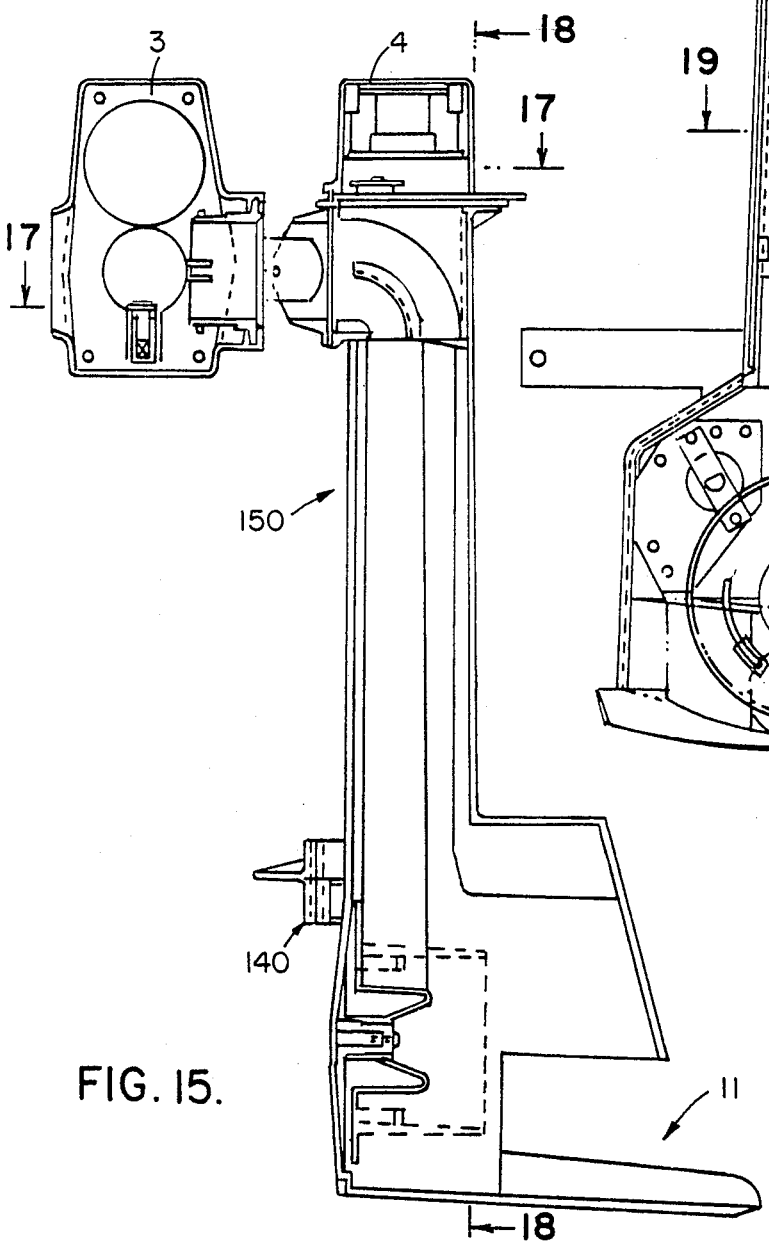
FIG. 15 is a side sectional view thereof.
Figure 18:
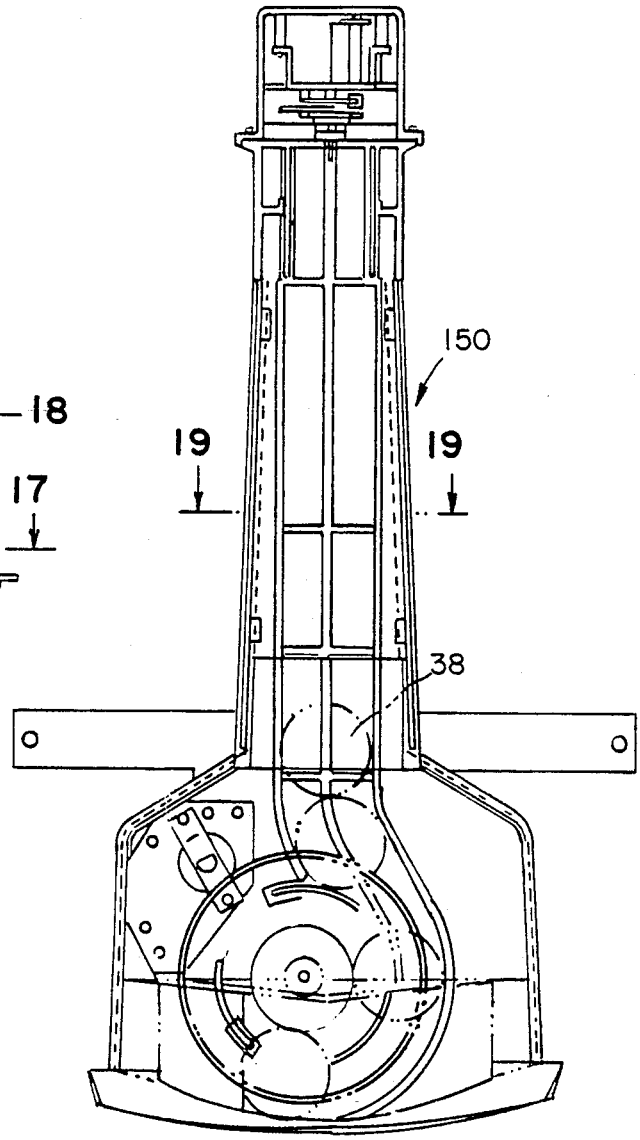
FIG. 18 is a sectional view, taken along the line 18—18 of FIG. 15.
Figure 17:
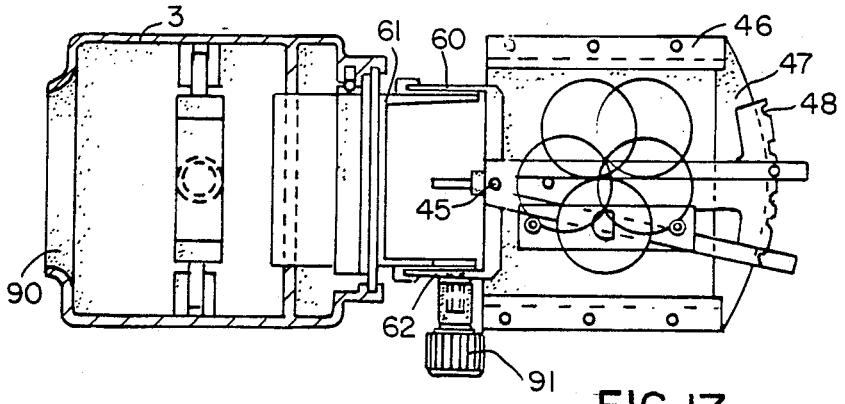
FIG. 17 is a sectional view, taken along the line 17—17 of FIG. 15.
Figure 19:
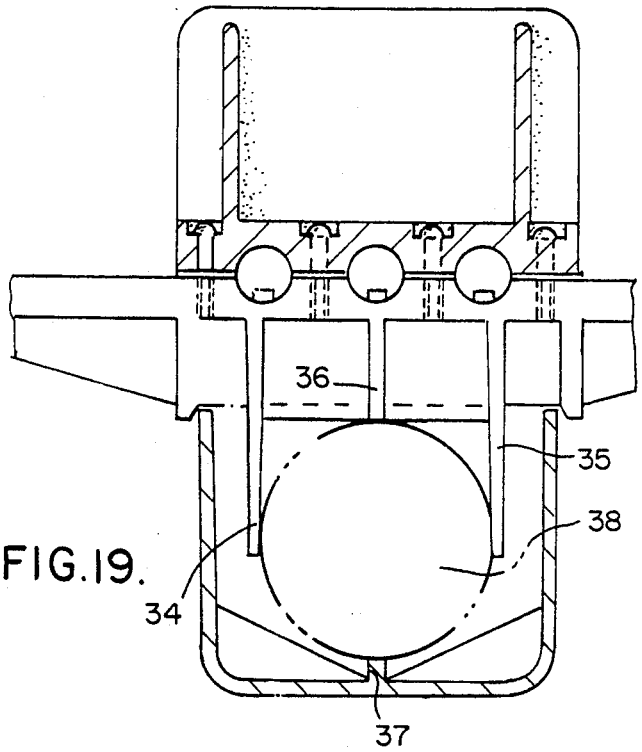
FIG. 19 is a sectional view, partly broken away, taken along the line 19—19 of FIG. 18.

As shown in FIG. 16, a single spring 135 is used to bias the block 85. Dual springs are used in conjunction with the embodiment of the robot shown in FIG. 7. In either case, the springs are used so that the block 85 is self adjusting.

Because of the re-arrangement of the mouth 11, a substantially simplied net structure 152 may be employed with the robot 150. Thus, a spider assembly 153 is attached to the robot 150 along a support 154. A plastic or similar material trowell 154 is attached to the spider 153 and is separable along a center connection 155. The spider 153 has a pair of arms 156 and 157 associated with it, which serve to support a net 158. As with the embodiment of the robot 1, the arms and trowell may be folded to the dash line position shown in FIG. 1, for storage of the robot. We have found that the robot 150 is substantially lower in cost than previous embodiments of our invention, primarily because the net structure is simplified. The trough 154 in particular can be manufactured at a lower cost, and the elimination of a stand is in large measure responsible for the decrease in cost.

The robots per se, however, function in substantially similar manners.

Numerous variations, within the scope of the appended claims, will be apparent to those skilled in the art in light of the foregoing description and accompanying drawings. For example, we envision that the robot 1 can be sold in a series of steps, which will reduce even its initially low cost. As shown in the various views, the design and aesthetic appearance of the robot 1 may be varied in other embodiments of this invention. While a single ball throwing motor was described as preferred, dual motors can be employed, if desired. One or more of the adjustable features may be eliminated if even lower cost is desired. These variations are merely illustrative.

Having thus described the invention, what is claimed and desired to be secured by Letters Patent is:

1. A robot serving assembly comprising a net, said net including a central portion having a plurality of pivoting arms attached at one end to said central portion in close proximity to one another and extending radially outwardly from said central portion in different angular positions so as to be foldable into a collapsed position adjacent one another for storage and carrying purposes, netting extending between said arms when said arms are moved to a predetermined extended position for maintaining said netting in an extended position, said netting also being attached to a trough device for receiving balls, said trough device being pivotally attached to opposite sides of said central portion and also being foldable adjacent said pivoting arms when collapsed, a robot server operatively mounted relative to the trough device in order to feed balls to said robot when said trough device is opened to an extended position, and means for attaching said robot to a table, said attachment means including a plurality of supporting arms mounted between said robot and respective upper and lower surfaces of said table, the length of the supporting arms engaging the upper side of the table being sufficiently shorter than the length of the supporting arms engaging the underside of said table so as to provide offset supporting arms engagement with the upper side and underside of the table for locking said supporting arms to said table by the weight of said robot.

2. In a robot serving assembly, the improvement comprising a net, said net including a central portion having a plurality of net arms extending outwardly from it, netting extending between said arms, a robot server being mounted to said net and positioned with respect to a bottom wall thereof so as to permit said bottom will to feed balls to said robot, and means for attaching said robot to a table, said attachment means comprises a plurality of supporting arms mounted between said robot and respective upper and lower surfaces of said tables, the length of the supporting arms engaging the upper side of the table being substantially smaller than the length of the supporting arms engaging the underside of said table so as to lock said supporting arms to said table by the weight of said robot.

3. The improvement of claim 2 wherein there is one upper supporting arm and two spaced lower supporting arms each laterally spaced outwardly from the upper supporting arm.

4. The improvement of claim 2 wherein said bottom wall is a trough device separable to permit folding of said net arms pivotally mounted to the central portion.

5. The device of claim 2 wherein said robot comprises an enclosure having a feed passage through it, said enclosure having a head structure at one end and a ball entrance at its other end interconnected by said feed passage;

means for feeding balls to said feed passage operatively associated with said ball entrance of said enclosure, balls being fed upwardly against gravity by said feeding means, said feed means being arranged so that insertion of a ball in said feed passage forces a ball into said head structure;

means for expelling a ball from said head upon insertion of a ball therein;

means for rotating said head with respect to said enclosure operatively associated with said head and said enclosure;

means for adjusting the elevation of a ball expelled from said head operatively connected between said head and said enclosure; and means for adjustably moving said head reciprocally, said last mentioned means operatively connecting said head to said enclosure.

6. The improvement of claim 5 further including control means for operating said robot positioned remotely from said robot and being operatively connected thereto.

* * * * *